US005145131A

United States Patent [19]

Franke

[11] Patent Number: 5,145,131

[45] Date of Patent: Sep. 8, 1992

[54] MASTER-SATELLITE RAILWAY TRACK CIRCUIT

[75] Inventor: Raymond C. Franke, Glenshaw, Pa.

[73] Assignee: Union Switch & Signal Inc., Pittsburgh, Pa.

[21] Appl. No.: 676,093

[22] Filed: Mar. 27, 1991

[51] Int. Cl.[5] ..... B61L 25/02

[52] U.S. Cl. ..... 246/122 R; 246/34 R

[58] Field of Search ..... 246/28 F, 34 R, 34 B, 246/58, 121, 122 R

[56] References Cited

U.S. PATENT DOCUMENTS

| | | | |
|---|---|---|---|
| 3,246,141 | 4/1966 | Ehrlich | 246/121 X |
| 3,359,416 | 12/1967 | Wilcox | 246/122 R X |
| 3,696,243 | 10/1972 | Risely | 246/121 |
| 3,753,228 | 8/1973 | Nickolas et al. . | |
| 3,821,544 | 6/1974 | Matty | 246/122 R X |
| 4,320,881 | 3/1982 | Campbell | 246/121 X |
| 4,415,134 | 11/1983 | Wilson | 246/34 R X |
| 4,498,650 | 2/1985 | Smith et al. | 246/34 R X |
| 4,619,425 | 10/1986 | Nagel | 246/34 R |
| 4,723,739 | 2/1988 | Franke . | |
| 4,728,063 | 3/1988 | Petit et al. | 246/34 R |
| 4,886,226 | 12/1989 | Frielinghaus | 246/121 |

*Primary Examiner*—Robert J. Spar
*Assistant Examiner*—Scott L. Lowe
*Attorney, Agent, or Firm*—Buchanan Ingersoll

[57] ABSTRACT

A railway track circuit for protection of an extended track block having a master unit at one end of the block and a satellite unit at the other. Each master and satellite unit having transmitting and receiving capabilities. The output impedance of the transmitters or of the receivers is of a low impedance as connected to the rails. Through an alternative transmit and receive sequence a link-up between the master and satellite units provides detection of broken rail and/or shunts from each end of the track circuit. The use of low impedance and detection at both ends of the section permit extended length track circuits.

40 Claims, 3 Drawing Sheets

MASTER-SATELLITE RAILWAY TRACK CIRCUIT

BACKGROUND OF THE INVENTION

In railroad signalling the fundamental building block is the rail track circuit. It is used primarily to detect the presence of a train on a section or block of track. Secondarily it provides a means for detecting broken rails within the section, although a broken rail generally cannot be distinguished by a receiver from an occupied track. The basis of the track circuit is using the two rails in a series arrangement with an electrical signal transmitter and an electrical signal receiver. The railway car wheels and axle spanning the rails acts as a shunt between the rails. This shunt path created by the presence of a wheel and axle set causes the transmitted electrical signal to short between the rails at the location of the train. This short blocks the signal being sent by the transmitter to the receiver and is used to detect the presence of a train within the block. Some of the factors in determining the maximum length of track in the block that can be protected by a track circuit includes the leakage paths that occur through the ballast from rail to rail. The leakage path through the ballast is generally considered to be a distributed resistance between the rails. This leakage resistance varies in actual operating conditions subject to moisture, quality of ballast, and other factors which are not in control of the railway signal circuit. Therefore the track circuit must operate over a range of ballast resistance that can normally occur in day-to-day operation of the railroad. It is common to express the maximum length while citing the worse case leakage in the ballast. For example, 12,000 foot at 3 ohms per thousand ballast. Technically the dimensions for this figure should be 0.33 mho per thousand, but it is common in the railway industry to express the term dimensionally as ohms per thousand. When ballast leakage resistance is expressed hereafter in ohms per thousand it will be understood by those skilled in the art to mean mho per thousand. As expressed in this example, 3 ohms per thousand is the minimum ballast; it must be recognized that the circuit must work over the entire range of ballast conditions, i.e., from 3 ohms to infinity. At minimum ballast the transmitted signal is attenuated the most, and the receiver must have adequate sensitivity to insure proper operation although the substantial shunt path that exists through the relatively low resistance offered by the ballast. At infinite ballast the receiver signal strength is at its maximum at the receiver end of the track circuit. When at infinite ballast it is a concern to insure that the railway wheel and axle assembly that creates a shunt path having a resistance normally expressed as 0.06 ohms will be detected. To properly function the track circuit must be capable of detecting this 0.06 ohm shunt from rail-to-rail at any place within the block. Another critical factor in determining the maximum length of a track circuit is the occurrence of a rail break at or near the center of the track circuit when the ballast is at an intermediate leakage condition, i.e., the ballast is between 7 ohms and 15 ohms per thousand. In this situation signal attenuation due to the broken rail is at a minimum and there is a greater likelihood of the break being undetected. One of the factors of high importance in achieving a greater track circuit length is the termination of the transmitter or source end with the lowest possible impedance consistent with meeting shunting sensitivity. With simple D.C. track circuits the practical limit of impedance is about 0.5 ohms in series with the battery or voltage source. At a significantly lower impedance, battery current would be excessive with a train shunting the track at the transmitter end. The battery or other voltage source would in essence have a 0.06 ohm shunt directly across the voltage source. In addition to causing excessively high current demands on the battery or voltage source, a sufficiently high voltage would remain imposed across the rails so that the receiver at the other end could not reliably detect the presence of the train. Such condition is clearly inconsistent with the demands of reliability for the track circuit. Under such conditions one train could be sitting on the end of the block associated with the transmitter and not attenuating sufficient signal from the rails to cause the receiver at the opposite end to detect its presence. The undetected train shunting a low impedance source end would permit the receiver to display an unoccupied block to a train entering the section.

With electronic track circuits wherein the voltage and current from the transmitter can be controlled achieving a source impedance approaching zero ohms while limiting short circuit current is entirely practical. However practical, such a power source would be unusable in a conventional track circuit in which one end of the circuit serves as a source and the other as a receiver. This is for the reasons stated above because a zero or near zero ohm source would be unworkable as the circuit would not properly shunt at the source end. If such a zero source impedance was to be used the track section could be increased significantly while maintaining broken rail detection. Traditional track circuits cannot exploit this advantage because the circuit may not reliably shunt at the transmitter or source end. These limiting conditions have generally required that existing track circuits were limited to a maximum block length of approximately 15,000 feet.

While it has been known to use both a source and a receiver at each end of the track circuit, such sources are still relatively high impedance devices limiting the maximum track circuit length. Such units can act in master and master and satellite modes to communicate between ends of the block but are limited by their impedance to traditional track circuit lengths.

SUMMARY OF INVENTION

Track circuits practicing the present invention include signal detection at both ends of a track circuit block. A master unit is placed at one end of the block and a satellite unit is placed at the alternative end. Both master and satellite units each have a receiver and a transmitter. Either of the receivers or both of the transmitters are low impedance devices. In presently preferred embodiments the master unit transmits a signal to the rail. The master unit after transmitting then acts as a receiver and if it receives a signal from the satellite unit the master unit determines that the track is unoccupied and/or the rail is not broken. The satellite unit always transmits a signal after receiving a signal. If the satellite receives no signal it indicates an occupied track and does not transmit. When a master unit receives no signal input it transmits a link-up signal and indicates the track as occupied. Satellite units that receive a link-up signal then transmit a link-up signal. When link-up signals are received by the master it can then indicate an unoccupied and transmit non-link-up signals.

Each unit by alternately transmitting and receiving each end of the track circuit acts alternatively as a source and a receiver. A low impedance transmitter permitting a longer track circuit is used since the signal is detected at both ends of the block. Therefore low impedance shunts by a train on the section of the track in the area of one unit will be detected by the shunting effect such train has as seen by the other end of the block.

DESCRIPTION OF PRESENTLY PREFERRED EMBODIMENTS

Figure 1:
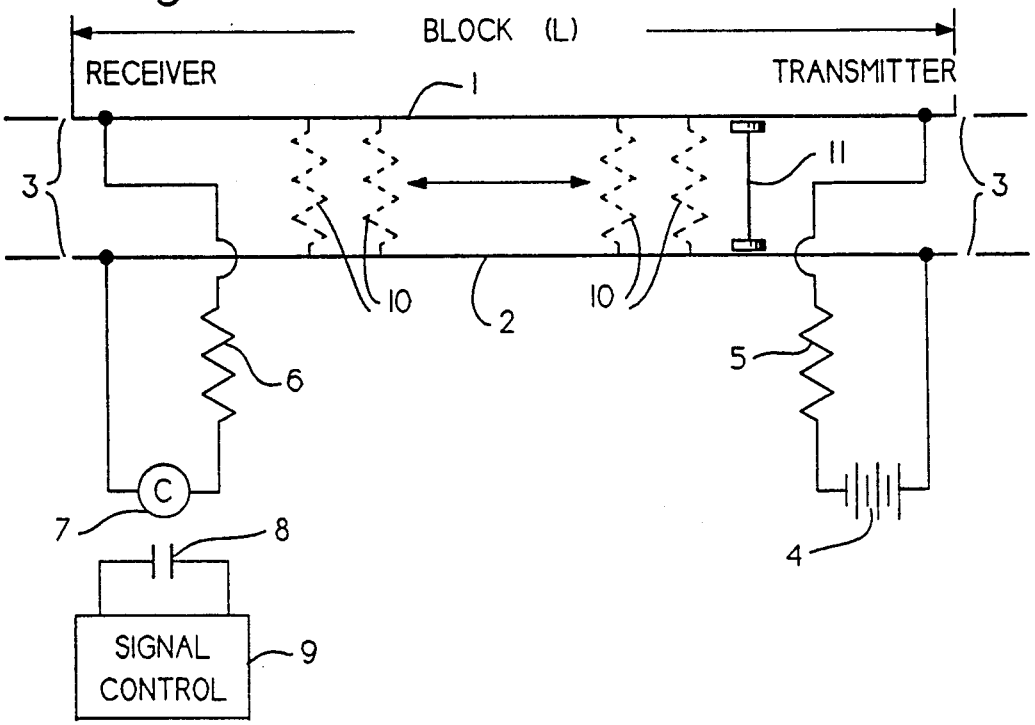
Fig.1. Prior Art
FIG. 1 is a schematic representation of a prior art track circuit.

Prior art track circuits whether A.C. or D.C. operated, basically have a transmitter located at one end of a block and a receiver located at the opposite end of a track block. FIG. 1 shows such prior art circuit using a D.C. source. The rails 1 and 2 are used to transmit a signal between a receiver and a transmitter end. A battery or other electrical power source 4 in series with a resistance 5 is connected across tracks 1 and 2. Tracks 1 and 2 are separated electrically from adjacent track sections by insulating joints, 3, or other means for separating the respective signals on adjacent blocks. Current carried in the rails 1 and 2 from the battery 4 is received at a receiver end of the block L by a vital relay having a coil 7 and a contact 8. Resistance 6 is shown and can include both the internal resistance of the coil itself and any external resistance desired in the circuit. Similarly, transmitter or source resistance 5 can be thought to include the internal resistance in the battery and any external resistance such as current limiting resistors. When the tracks 1 and 2 are clear and no broken rail exists within the block the circuit includes the series elements battery 4, transmitter resistor 5, rail 1, receiver resistance 6, receiver relay coil 7, and rail 2. The current path is now available to operate the relay coil and cause the contact 8 to indicate to the signal control 9 that the track is unoccupied. The signal control operates aspect lights or other indication permitting the train to properly recognize the block as being occupied or unoccupied. Because the rails 1 and 2 are bedded in the ballast there exists a certain ballast resistance 10 which can be thought of as being a distributed shunt path between rails 1 and 2 from the transmitter end to the receiver end. This ballast resistance 10, which varies, can be accounted for by the track circuit design and selection of component values. However, such ballast resistance does limit the overall length of the block, L. Trains on the block are detected by the presence of a shunt such as the wheel and axle 11 which causes the current path from the battery 4 to travel through the shunt path 11 thereby greatly reducing the current which passes through the coil 7. The relay coil 7 is selected so as to be sensitive enough to detect the presence of the axle 11 and drop out when the shunt in axle 11 is present anywhere on the block.

As can be seen by FIG. 1, if resistance 5 is sufficiently low relative to shunt 11 and the shunt 11 exists in close proximity to the transmitter end of the block; a large percentage of the voltage potential of the battery 4 will be imposed across the shunt 11 and simultaneously across rails 1 and 2. Since the full voltage is now imposed across the rails 1 and 2 without sufficient voltage drop across resistance 5 the receiver end of the track circuit having coil 7 receives its normal unoccupied current signal. Under this condition the relay contacts 8 can be picked up indicating an unoccupied block even though the train having shunt 11 occupies the same block. It has been necessary therefore in prior art track circuits to maintain the transmitter or source resistance 5 at a level typically of about 0.5 ohms or higher. While decreasing the source impedance below this value would permit longer lengths of track to be operated by the circuit, such circuits could not detect the presence of the train in close proximity to the source or transmitter end.

Similarly, while it may be desirable to use a low impedance receiver permitting longer track sections, lower values for receiver resistance 6 may not detect shunts 11 placed near the receiver end 6,7 of the block. If the resistance 6 is low compared to the impedance of the shunt 11, the current diverted from the receiver by the shunt may not be sufficient to drop out contact 8, especially in the region immediately adjacent the receiver.

Figure 2:
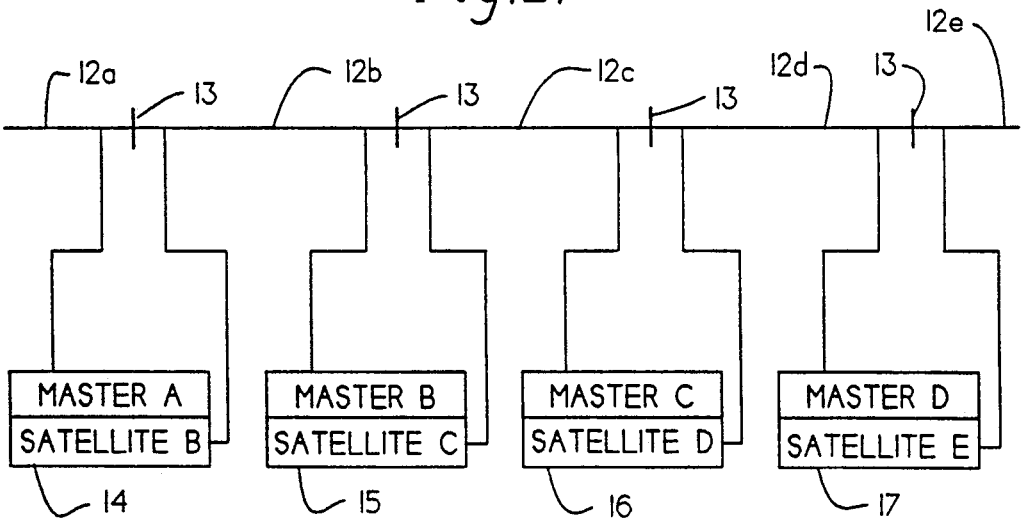
FIG. 2 is a single line diagrammatic representation showing four wayside locations having respective master and satellite units.

In FIG. 2 there is shown a presently preferred embodiment of the invention which is shown in a single line diagram having a set of rails 12 comprising track blocks 12*a*, 12*b*, 12*c*, 12*d*, and 12*e*. These track sections are separated by insulation points 13 which may be electrical insulating joints or other devices such as high impedance bonds which permit the signals on the respective track sections to be isolated from one another. Other types of known means for providing such operation of adjacent track signals can also be used in practicing this invention. At each track control site 14, 15, 16, 17 are located control units each having a master and a satellite portion. As can be seen, site 14 controls a master portion A for track block 12*a* and a satellite portion B for track block 12*b*. Track site 15 contains a master portion b for track block 12*b* and a satellite portion c for track block 12*c*. Master B at site 15 operates in conjunction with satellite B at location 14 to provide track circuit protection to the track block 12*b*. Similarly master portion C at site 16 operates in conjunction with satellite portion C at location 15 to provide track circuit protection to track block 12*c*. Master portion D and satellite portion D respectively located at 17 and 16 provide similar functions to block 12*d*.

Figure 3:
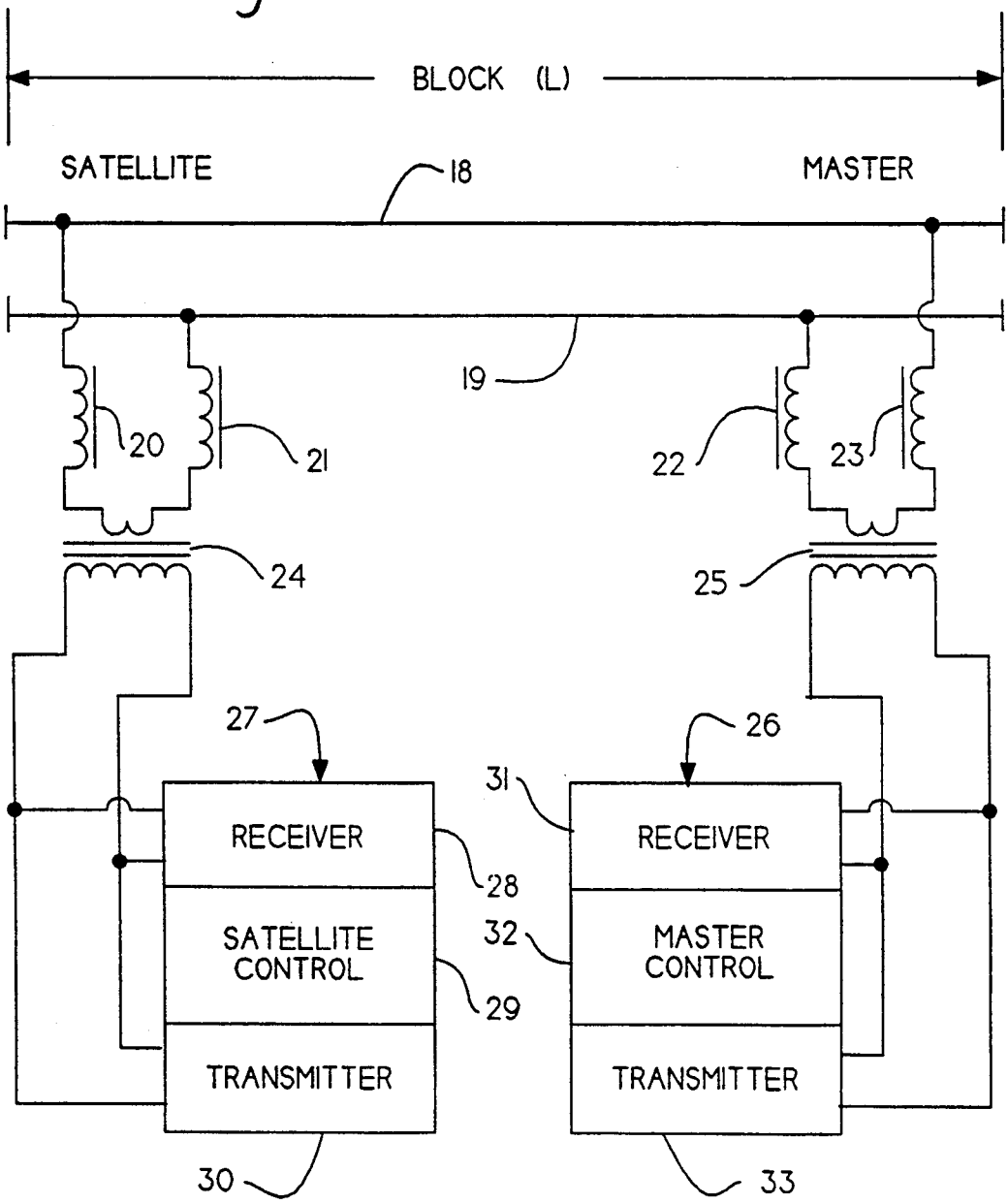
FIG. 3 is a schematic representation of a track circuit of a presently preferred embodiment showing a master and a satellite unit.

Referring to FIG. 3 there is shown a diagrammatic of a single track section having a block, L, with rails 18 and 19. On one end of block L there is attached to the tracks a master portion (or unit) 26. In presently preferred embodiments the master portion (or unit) 26 is attached to the track at the master end of the block through master chokes 22 and 23. A master unit 26 is then connected to the tracks through master transformer 25. The master unit 26 includes a receiver 31 and a transmitter 33. The master unit 26 provides the functions to either transmit signals to the rails 18 and 19 at the master end of block or receive signals at the master end of the block. The master control 32 controls the operation of the transmitter and receiver modes and the information that will be sent by the transmitter 33 or the information which is monitored from the receiver 31. The master control 32 can control the receiver 31 and transmitter 33 so as to alternatively transmit and receive signals from the master end of block L. The master unit 26 is conditioned to always transmit and pause waiting for a return message. This pattern is independent of a return message being received. If no signal is received, or a low level signal indicating the presence of a train or a broken rail, the master transmitter 33 will only transmit a predetermined linkup signal. It is to be understood that very specific codes or link-up signals will be used and that respective transmitters and receivers will recognize only those codes which have been assigned to it as being indicative of a link-up.

At the satellite end of block L the satellite chokes 20 and 21 are connected to a satellite transformer 24. The secondary of the transformer 24 is then connected to both the transmitter 30 and the receiver 28. The satellite unit 27 contains receiver 28, transmitter 30, and satellite control 29. The satellite control 29 controls the alternate transmit/receive cycles of the satellite unit and controls the information that is to be placed into transmission or the information which is desired to be monitored from the receiver 27. Both the satellite control 29 and the master control 32 have the ability to output to typical railway wayside equipment which would provide signal or aspect information to the train and which can provide a two-way communication link between the train, the masters, and the satellites.

The satellite unit is conditioned to transmit only in response to having received a message. When a signal is received at 27, the transmitter 30 will then send a return message, usually aspect or track information. When receiver 27 receives a predetermined link up signal, the transmitter 30 then responds by sending a predetermined link-up signal.

The presently preferred embodiments of the invention include coded circuits having alternative positive and negative pulses. The invention can be used with either AC or DC signals and with coded track circuits, and with a wide variety of coded information. The chokes 22 and 23 have a combined inductance in presently preferred embodiments of approximately 15 mh. Chokes 20 and 21 have a similar combined inductance. Transformer 25 can be used to reduce the impedance of the transmitter 33 to a low value as it is applied to rails 18 and 19. Typically in preferred embodiments the transformer 25 can have a 7 to 1 turns ratio providing a 49 to 1 impedance ratio between the transmitter/-receiver side and the rail side of the transformer 25. Satellite transformer 24 can be a similar device.

Information other than train and broken rail detection can be sent across the track circuit using rails 18 and 19, and receivers 28, 31 and transmitters 30, 33. While in preferred embodiments receivers and transmitters do in fact send other communication signals such as aspect information between the satellite location and the master location, the following descriptions will only stress the transmitted and received signals used to detect both broken rail and the presence of a train on the track block. Receivers 26 and 27 and transmitters 30 and 33 can be of any known type consistent with the specific type of track circuit, AC or DC. To achieve the long block length L which is a primary advantage of this invention it is desirable that at least the receivers or the transmitters be of low impedance having an impedance of approximately 0.3 ohms or less at the rails.

One presently preferred embodiment using low impedance transmitters includes FET type static reversing switches across a controlled solid state voltage source. Such a device has an output impedance which when coupled through the transformer 24,25 with ratio (7:1) gives a transmitter impedance at the rail of approximately 0.1 ohms. Such transmitters can be used in track circuits up to 22,000 feet or more.

Referring to FIG. 3 the transmitter 33 at the master end can first transmit a signal, such as aspect information, which is delivered to the rails 18 and 19 through the transformer 25 and chokes 22, 23. If the track is unoccupied and if the integrity of the rails 18 and 19 is secure, the signal transmitted by transmitter 33 is received at the satellite end by receiver 27 through chokes 20 and 21 and transformer 24. Having received the signal, the satellite control 29 can now indicate an unoccupied track at the satellite end of block. In addition to receiving the signal the satellite unit 27 can also transmit signals via transmitter 30 through transformer 24 and chokes 20 and 21 to the satellite end of rails 18 and 19. If the rails are unoccupied and no broken rail condition exists, the signals are transmitted through the rails 18 and 19 from the satellite end of block L to the master end of block L. The receiver 31 in the master unit 26 now receives the signal that has been broadcast by transmitter 30. When the master control recognizes the signal it has received it can then indicate that the block L is unoccupied.

If we now consider the track 18 and 19 occupied by a train having a shunt path between rails 18 and 19 or a broken rail condition, the transmitter 33 in the master unit 26 will still send out a signal via transformer 25 to rails 18 and 19. Because of the broken rail between the master and the satellite and/or the shunt path created by an occupying rail vehicle, the signal will not be received at the satellite end. Because the satellite receiver 27 does not receive the signal it does not transmit via transmitter 30. Since transmitter 30 in the satellite unit is not transmitting its satellite signal to the rails 18 and 19 the master receiver 31 in unit 26 cannot receive a signal. The master control 32 recognizes that it is not receiving the satellite signal and therefore it changes its output condition to indicate that the track is in an occupied condition, and master transmitter 33 begins to transmit only a predetermined link-up coded signal.

Since the shunt blocks the link-up signal from reaching the satellite receiver 28, the satellite unit receives no signal and indicates an occupied track. Since no signal was received at satellite unit 27, satellite transmitter 30 is silent and transmits no signal.

Master receiver 26 does not receive any signal from rails 18,19, so control 32 continues to indicate an occupied track. The master unit will continue to alternatively transmit a link-up signal and then listen for a response from the satellite. As long as the train (shunt) is present no signal is received at 31, or 28, transmitter 30 is silent, transmitter 33 is periodically transmitting a link up signal, and both master 26 and satellite 27 controls are indicating an occupied track.

When the train (shunt) is removed from the rails the master link-up signal from 33 is received at satellite receiver 28, and transmitter 30 in response sends a satellite link-up signal to the rails. Since the train is gone, the satellite signal is now received at the master receiver 31, so transmitter 33 can return to its unoccupied mode of sending other than link-up signals. The satellite receiver 28 then detects such non link-up signals and satellite transmitter 30 sends non link-up signals to rails 18,19. The master unit 26 upon receipt of the non link-up signals displays an unoccupied track, and continues to alternatively send non-link up and listen.

Because the impedance of the transmitters or the receivers at the master and the satellite units is low the block length L may be much larger than prior art track circuits using higher impedance transmitters.

In prior art track circuits one of the limiting factors was the ability to detect a shunt load between rails in the vicinity of the transmitter or receiver. If we now consider such shunts loads to exist for example at the source transmitter end of block L where the impedance of the transmitter circuit is very low, such as from 0.3 ohms to zero ohms, the track circuit of FIG. 3 will detect the shunt. If we assume the master end of block L to be shunted by a wheel/axle, the transmitter 33 will then transmit into rails 18 and 19. Since the load of the shunt is very high, a corresponding low impedance of the shunt, a substantial signal level may be placed across rails 18 and 19. This signal may then be transmitted across rails 18 and 19 and be received by receiver 28. The satellite control 29 will recognize the signal as being an indication of an unoccupied track and direct transmitter 30 to generate a satellite signal and feed it to rails 18 and 19. The low impedance at the satellite end is not a problem because the shunt is at the master end of the length block L. The satellite signal generated by transmitter 30 will then travel along the rails which have a certain internal attenuating impedance to the master end of block L. The low impedance of the shunt, such as a train occupying the master end of block L, will now cause the signal from the satellite transmitter 30 to be attenuated or shunted away from receiver 31. In the receive mode the input impedance is much higher and now the shunt at the master end, which was ineffective in the transmit mode, is more effective. It attenuates the received signal below the threshold of detection and the presence of the train is now recognized at the master end. Because receiver 31 cannot receive the signal from transmitter 30, the master control 32 will now default to indicating an occupied track for the block L. The master control 32 will also begin to direct transmitter 33 to send a link-up signal while displaying an occupied track condition. Even if received at the satellite end of the block through the shunt by the satellite receiver 28, the signal from transmitter 33 will be detected by receiver 28 as a link-up signal and the satellite control 29 will indicate an occupied track as well. The satellite unit will then transmit a linkup signal to the master receiver 31, and the master control will continue to display an occupied condition.

Similarly if we consider the occupying vehicle to occur at the satellite end of the block L, a master unit will transmit via transmitter 33 a signal to track 18 and 19. The low impedance of transmitter 33 is of no consequence to detection by receiver 28 since the shunt is located at the satellite end of the tracks. The shunt placed at the satellite end will now be detected, by the satellite receiver 28 failing to receive the signal, and control 29 will indicate an occupied track. Therefore the satellite control 29 will not direct the transmitter 30 to send a signal to the master unit. Not receiving a signal at receiver 31 the master control will display an occupied condition and transmitter 33 will begin to send link up signals and listen. Similarly since the receiver 28 is nor receiving a signal, due to the shunt of the occupying vehicle, the satellite control 29 will continue to indicate an occupied track section at the satellite end of the track.

While the operation of the embodiment shown in FIG. 3 has been directed to the transmission and receipt of occupied signals, it is to be understood that during unoccupied conditions the respective satellite transmitters and receivers can be periodically sending other types of communications back and forth between the master and satellite ends of the block. In some embodiments it may be desirable that the link-up signal that the satellite control receiver 28 recognizes will be the same link-up signal that the satellite transmitter 30 will send. Similarly, the master control receiver may use the same coded link-up signal that the master control transmitter uses. In certain embodiments it may be desirable that the satellite transmitter and the master control receiver use a specific link-up signal, while the master transmitter and the satellite receiver can use a different link-up signal or code.

Because the master and satellite units alternatively function as receiver and transmitter, either one being a low impedance device, the master and satellite units will continually cycle from low to high impedance as track circuit elements. This may be visualized as the track circuit having the low impedance device alternatively swapping ends of the block.

In some preferred embodiments it may be desirable to have the master unit unlock from the link-up signal, and send other information immediately upon receipt of a link-up signal, but maintain an indication of track occupancy until receipt of a non-link-up signal. This provides an additional round of communication between master and satellite before indicating an unoccupied track. Similarly further redundant checks can be achieved by only permitting the signal track condition to change to a more permissive display, after receipt of a predetermined number of consecutive non-link-up signals are received.

The satellite unit 27 in preferred embodiments will indicate an occupied track when it receives a link-up signal or no signal is received. During this occupied condition the satellite will transmit a link-up if a link-up was received, or will be silent if no signal was received. This satellite unit will indicate an unoccupied condition only when signals other than a link-up signal are received. When indicating unoccupied, the satellite will transmit signals other than link-up signals, when responding to the receipt of a non-linkup signal.

The master unit 26 in preferred embodiments will indicate an occupied condition when no signal is received, and will then periodically transmit a link-up signal. When a link-up signal is received, the master will then transmit other than a link up signal. Some embodiments will wait a predetermined time or cycles of non-link-up receipts before indicating an unoccupied track. When the master receives other than link-up signals it will indicate an unoccupied condition and transmit other than link-up signals.

Figures 4A, 4B, 4C, 4D, 4E, 4F, 4G, 4H:
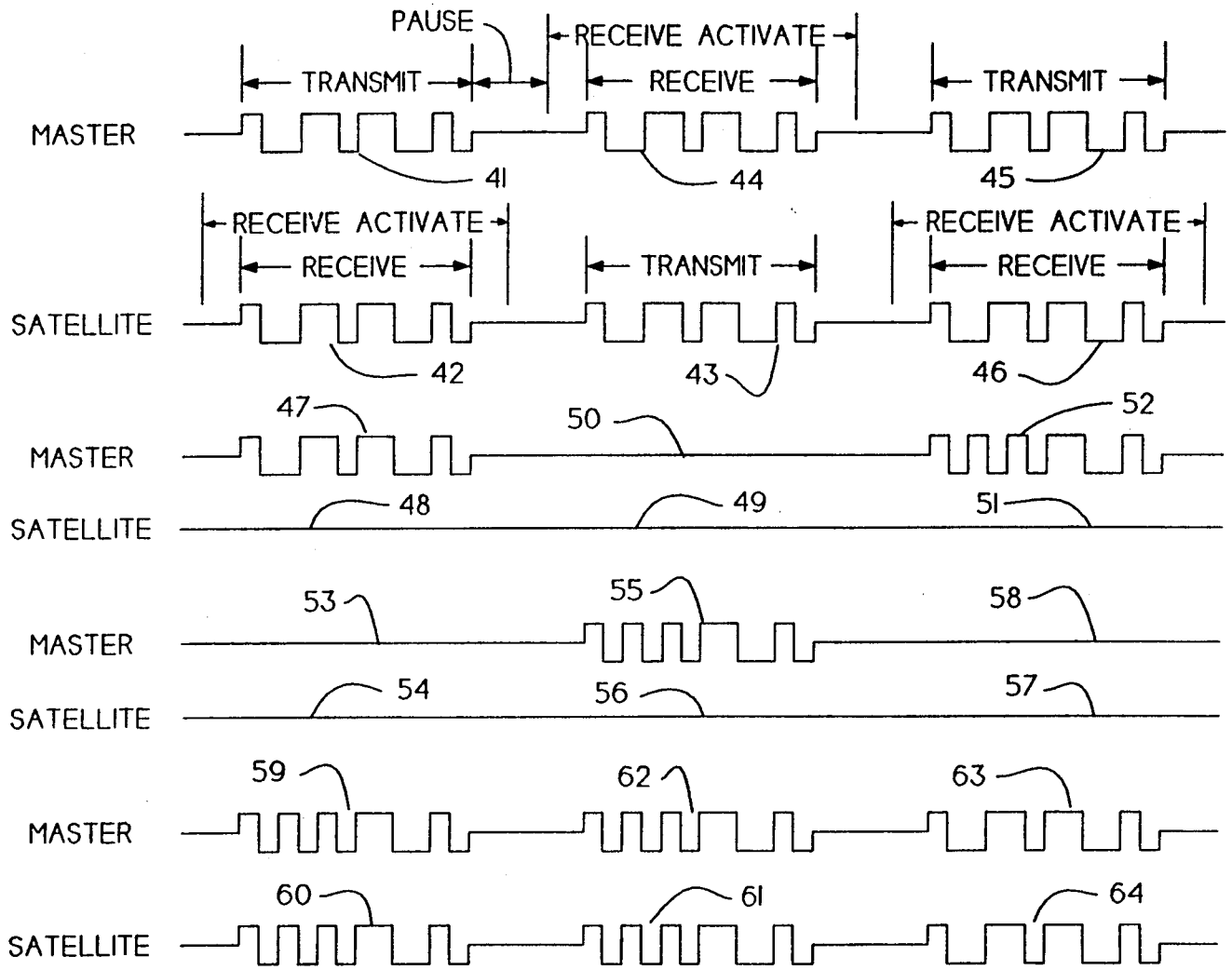
FIGS. 4A–4H are a diagrammatic representation of a presently preferred embodiment of master and satellite units transmit and receive activity.

Further understanding of the invention will be gained by reference to FIG. 4, which shows typical transmit receive modes between a master and a satellite unit. FIG. 4 shows the sequential transmit and receive phases of a master unit in FIG. 4A and a satellite unit in FIG. 4B. FIG. 4A shows the master unit first transmitting a signal 41 which in this instance we will take as an example to be indicative of a clear aspect signal. FIG. 4B shows the same signal 42 when it is received at the satellite unit. Upon receiving the signal 42 the satellite unit will indicate an unoccupied track, and as shown in FIG. 4B will then transmit a signal 43 other than a link-up code signal from the satellite end of the block. In the example shown in FIG. 4B the same non-link-up code is used by both the master and the satellite. Simultaneously with the transmission of the signal 43 by the satellite unit, the master unit in FIG. 4A receives the signal 44. Upon receipt of the signal 44 at the master unit, the master unit will indicate the track section as being unoccupied. Periodically again the master unit will transmit a non-link-up signal 45. FIG. 4A shows the second master transmission, a signal 45 and directly below it on FIG. 4B the signal 46 is received by the satellite unit. Upon receipt of signal 46 the satellite unit will transmit a signal and continues to display an unoccupied signal at the satellite end of the block. FIGS. 4A and 4B show an unoccupied track communication sequence between the master and the satellite unit when only the non-link up code transmissions are involved. It is to be understood that the times between the periods of link-up codes being sent can be devoted to communication of other information between the master and the satellite.

If one link-up code is used by both the master and the satellite units, then the receivers and transmitters of respective masters and satellites throughout the system can be quite similar. The examples in FIG. 4C through 4H use the same link up code for both master and satellite units. FIG. 4C through 4F show a master/satellite circuit sequence wherein a train on the track provides a shunt condition intermediate the master and satellite positions. FIG. 4C shows a signal 47 that is transmitted from the master unit. In FIG. 4D the satellite unit does not receive the transmission at 48 from the master unit because of the shunt and therefore does not transmit any signal at 49. The satellite unit will now display an occupied condition. The master unit can therefore not receive a signal at 50, and not receiving such code it may display an occupied condition. The master transmits a link-up code 52 to the rails. The satellite unit will fail to receive the link-up signal at 51, due to the shunt. Should the satellite signal erroneously transmit a link-up code, such link-up code signal will then be shunted by the occupying vehicle wheel shunt so that the master will continue to indicate an occupied track. FIG. 4D shows that the satellite transmitter outputs no signal during a track occupancy because it receives no signal.

The satellite transmitter is silent, without transmission, at 54 since it received no signal at 51. The master receiver at 53 detects no signal so the master continues to display "occupied", but will sequentially transmit a link-up signal at 55 in response to no signal being received. With the axle shunting, the master link-up signal is not received at 56, and therefore the satellite transmitter is silent at 57. Without a transmission at 57 the master receiver detects no signal at 58. While the shunt is in the block the pattern of 4E, 4F continues.

FIGS. 4G, 4H show the track circuit as it unlocks when the shunt is removed. The master transmitter will be transmitting periodic link-up signals, such as 59. When such signals are detected by the satellite receiver at 60, the satellite transmitter will transmit a link-up signal 61, in this example the same link-up code is used for both master and satellite transmissions. Receipt of a link-up signal 62 by the master receiver causes the master unit to shift the messages being transmitted to a non-link-up signal 63, such as aspect information. This shift can also cause the master unit to display an unoccupied condition in some embodiments. Other embodiments will await a second or subsequent receipt before changing indications. Initial receipt of a non-link-up signal 64 by the satellite will in some embodiments cause the indications of the satellite unit to change; other embodiments may await receipt of further coded non-link-up signals. With the tracks cleared the circuits patterns following signal 63 and 64 will revert to the normal unoccupied transmissions such as those described in 4A and 4B.

The signal shown in FIG. 4A through 4G have been shown as pulsed alternative polarity codes. In the presently preferred embodiments, the encoded link-up signal is characterized by an equal number of positive and negative pulses. This type of encoding requires a zero cross of the signal for the receiver to recognize a pulse. Because the signal contains a code which is determined by the zero crossing of the signal from positive to negative, or negative to positive, severe distortion and attenuation of the encoded signal in the track circuit does not degrade the sensitivity of the receiver to recover the coded signal with great fidelity. This type of zero crossing pulse signal is significant in utilizing the extended length of the track circuit as consistent with the teachings of this invention. Such signal coded structure is a presently preferred embodiment. Typically the code in presently preferred embodiments can have a peak-to-peak magnitude of two volts and frequencies on the order of magnitude of five hertz or less.

Although certain preferred embodiments have been described and shown herein, it is to be understood that various other embodiments and modifications can be made within the scope of the following claims.

I claim:

1. A railway track circuit for connecting to a track section to detect the presence of a railway vehicle on such track section comprising:

(a) a master transmitter having means for transmitting a master signal onto one end of such track section;

(b) a satellite receiver having means for receiving said mater signal at the opposite end of such track section;

(c) a satellite transmitter having means for transmitting a satellite signal onto said opposite end of such track section only in response to the receipt of said master signal by said satellite receiver;

(d) a master receiver having means for receiving said satellite signal at said one end of such track section;

(e) said transmitters and said receivers each have an impedance less than 0.3 ohms as coupled to the rails of such track section; and (f) said satellite transmitter transmits a satellite linkup signal in response to said satellite receiver detecting a master link-up signal.

2. A railway track circuit for connecting to a track section to detect the presence of a railway vehicle on such track section comprising:

(a) a master transmitter having means for transmitting a master signal onto one end of such track section;

(b) a satellite receiver having means for receiving said master signal at the opposite end of such track section;

(c) a satellite transmitter having means for transmitting a satellite signal onto said opposite end of such track section only in response to the receipt of said master signal by said satellite receiver;

(d) a master receiver having means for receiving said satellite signal at said one end of such track section; and (e) said master transmitter and said satellite transmitter each have a low impedance and have an impedance greater than the individual impedance of said master receiver and said satellite receiver as coupled to the rails of such track section.

3. The railway track circuit of claim 2 wherein the impedance as coupled to such track of said master transmitter and said satellite transmitter is equal to or less than 0.3 ohms.

4. The railway track circuit of claim 2 wherein said master transmitter and said satellite transmitter have an impedance greater than the impedance of said master receiver and said satellite receiver as coupled to the rails of said track.

5. The railway track circuit of claim 4 wherein said master transmitter sequentially transmits a master signal after said master receiver has monitored such track for said satellite signal.

6. The railway track circuit of claim 5 wherein the master transmitter transmits as said master signal a master link-up signal to said one end of such track section in response to said master receiver not receiving said satellite signal.

7. The railway track circuit of claim 6 wherein said master transmitter transmits a signal other than said master link-up signal as said master signal in response to receipt of said satellite signal.

8. The railway track circuit of claim 7 wherein said master transmitter transmits a signal other than said master link-up signal as said master signal in response to receipt of said satellite signal that is other than a satellite link-up signal.

9. The railway track circuit of claim 8 further including a master control means that indicates an unoccupied condition when only said satellite signal is periodically received by said master receiver.

10. The railway track circuit of claim 9 wherein said master control means indicates an occupied condition when said satellite signal is not received by said master receiver for a given period.

11. The railway track circuit of claim 4 wherein said satellite transmitter transmits a satellite link-up signal in response to said satellite receiver detecting a master link-up signal.

12. The railway track circuit of claim 11 wherein said satellite transmitter transmits a satellite signal other than a satellite link-up signal in response to said satellite receiver detecting a master signal other than a master link-up signal.

13. The railway track circuit of claim 12 wherein said satellite control means further indicates an occupied condition when said satellite receiver detects a master linkup signal or a lack of any master signal for a given period.

14. The railway track circuit of claim 12 further including a satellite control means for indicating an unoccupied condition only upon periodic receipt of said master signal other than said master link-up signal.

15. The railway track circuit of claim 14 wherein said satellite control means further indicates an occupied condition when said master signal is not received by said satellite receiver.

16. A railway track circuit for connecting to a track section to detect the presence of a railway vehicle on such track section comprising:

(a) a master transmitter having means for transmitting a master signal onto one end of such track section;

(b) a satellite receiver having means for receiving said master signal at the opposite end of such track section;

(c) a satellite transmitter having means for transmitting a satellite signal onto said opposite end of such track section only in response to the receipt of said master signal by said satellite receiver;

(d) a master receiver having means for receiving said satellite signal at said one end of such track section; and (e) said master receiver and said satellite receiver each have a low impedance and each have an impedance greater than the individual impedance of said master transmitter and said satellite transmitter as coupled to the rails of such track.

17. The railway track circuit of claim 16 wherein the impedance as coupled to such track of said master transmitter and said satellite transmitter is equal to or less than 0.3 ohms.

18. The railway track circuit of claim 16 wherein said master transmitter sequentially transmits a master signal after said master receiver has monitored such track for said satellite signal.

19. The railway track circuit of claim 18 wherein the master transmitter transmits as said master signal a master link-up signal to said one end of such track section in response to said master receiver not receiving said satellite signal.

20. The railway track circuit of claim 19 wherein said master transmitter transmits a signal other than said master link-up signal as said master signal in response to receipt of said satellite signal.

21. The railway track circuit of claim 20 wherein said satellite transmitter transmits a satellite link-up signal in response to said satellite receiver detecting a master link-up signal.

22. The railway track circuit of claim 20 wherein said master transmitter transmits a signal other than said master link-up signal as said master signal in response to receipt of said satellite signal that is other than a satellite link-up signal.

23. The railway track circuit of claim 22 further including a master control means that indicates an unoccupied condition when only said satellite signal is periodically received by said master receiver.

24. The railway track circuit of claim 23 wherein said master control means indicates an occupied condition when said satellite signal is not received by said master receiver for a given period.

25. The railway track circuit of claim 22 wherein said satellite transmitter transmits a satellite link-up signal in response to said satellite receiver detecting a master link-up signal.

26. The railway track circuit of claim 25 wherein said satellite transmitter transmits a satellite signal other than a satellite link-up signal in response to said satellite receiver detecting a master signal other than a master link-up signal.

27. The railway track circuit of claim 26 wherein said master transmitter transmits a signal other than said master link-up signal as said master signal in response to receipt of said satellite signal that is other than a satellite link-up signal, said railway track circuit further including a satellite control means for indicating an unoccupied condition only upon periodic receipt of said master signal other than said master link-up signal.

28. The railway track circuit of claim 27 wherein said master transmitter transmits a signal other than said master link-up signal as said master signal in response to receipt of said satellite signal that is other than a satellite link-up signal.

29. The railway track circuit of claim 16 wherein said satellite transmitter transmits a satellite link-up signal in response to said satellite receiver detecting a master link-up signal.

30. The railway track circuit of claim 29 wherein said master transmitter transmits a signal other than said master link-up signal as said master signal in response to receipt of said satellite signal.

31. The railway track circuit of claim 29 wherein said master transmitter transmits a signal other than said master link-up signal as said master signal in response to receipt of said satellite signal that is other than a satellite link-up signal.

32. The railway track circuit of claim 29 wherein said satellite transmitter transmits a satellite signal other than a satellite link-up signal in response to said satellite receiver detecting a master signal other than a master link-up signal.

33. The railway track circuit of claim 32 wherein said master transmitter transmits a signal other than said master link-up signal as said master signal in response to receipt of said satellite signal that is other than a satellite link-up signal.

34. The railway track circuit of claim 32 further including a satellite control means for indicating an unoccupied condition only upon periodic receipt of said master signal other than said master link-up signal.

35. The railway track circuit of claim 34 wherein said satellite control means further indicates an occupied condition when said master signal is not received by said satellite receiver.

36. The railway track circuit of claim 34 wherein said satellite control means further indicates an occupied condition when said satellite receiver detects a master link up signal or a lack of any master signal for a given period.

37. A method of detecting the presence of railway vehicles and broken rail between a master and a satellite location comprising:

(a) monitoring the rails at such master location for a period of time with an impedance of less than 0.3 ohms as coupled to said rails;

(b) sequentially transmitting a master link-up signal at the master location with an impedance greater than 0.3 ohms as coupled to said rails in response to no signal detected during said monitoring, and sequentially transmitting at said master location with an impedance greater than 0.3 ohms as coupled to said rails a master signal other than said master link up signal in response to said satellite signal;

(c) monitoring the rails at such satellite location with an impedance of less than 0.3 ohms as coupled to said rails, and transmitting at said satellite location with an impedance greater than 0.3 ohms as coupled to said rails a satellite link-up signal in response to receipt of a master link-up signal, and transmitting at said satellite location with an impedance greater than 0.3 ohms as coupled to said rails a satellite signal other than said satellite link-up signal in response to receipt of said master signals other than said master link-up signals;

(d) indicating an unoccupied condition at said satellite location only in response to receipt of master signals other than said master link-up signal; and (e) indicating an unoccupied condition at said master location in response to receipt of satellite signals other than said satellite link-up signal.

38. The method of detecting the presence of railway vehicles and broken rail between a master and a satellite location according to claim 37 further comprising using the same coded signal for both said master link-up signal and said satellite link-up signal.

39. A method of detecting the presence of railway vehicles and broken rail between a master and a satellite location comprising:

(a) monitoring the rails at such master location for a period of time with an impedance greater than 0.3 ohms as coupled to said rails;

(b) sequentially transmitting a master link-up signal at the master location with an impedance less than 0.3 ohms as coupled to said rails in response to no signal detected during said monitoring, and sequentially transmitting at said master location with an impedance less than 0.3 ohms as coupled to said rails a master signal other than said master link-up signal in response to said satellite signal;

(c) monitoring the rails at such satellite location with an impedance greater than 0.3 ohms as coupled to said rails, and transmitting with an impedance of less than 0.3 ohms as coupled to said rails, a satellite link-up signal in response to receipt of a master link-up signal, and transmitting with an impedance less than 0.3 ohms as coupled to said rails a satellite signal other than said satellite linkup signal in response to receipt of said master signals other than said master link-up signals;

(d) indicating an unoccupied condition at said satellite location only in response to receipt of master signals other than said master link-up signal; an (e) indicating an unoccupied condition at said master location in response to receipt of satellite signals other than said satellite link-up signal.

40. The method of detecting the presence of railway vehicles and broken rail between a master and a satellite location according to claim 39 further comprising using the same coded signal for both said master link-up signal and said satellite link-up signal.

* * * * *